US006997372B2

(12) United States Patent
Gasparowicz

(10) Patent No.: US 6,997,372 B2
(45) Date of Patent: Feb. 14, 2006

(54) WRAP-AROUND CARRIER SLEEVE WITH IMPROVED ARTICLE RETAINING FEATURE

(75) Inventor: Mark A. Gasparowicz, Mississauga (CA)

(73) Assignee: Cascades Canada Inc., Mississauga ( * ) Notice: Subject to any disclaimer, the term of this patent is extended or adjusted under 35 U.S.C. 154(b) by 126 days.

(21) Appl. No.: 10/807,083

(22) Filed: Mar. 23, 2004

(65) Prior Publication Data

US 2005/0211757 A1 Sep. 29, 2005

(51) Int. Cl.
*B65D 5/42* (2006.01)

(52) U.S. Cl. ..... 229/198.2; 206/427; 229/103.2

(58) Field of Classification Search ..... 229/103.2, 229/198.2; 206/141, 427
See application file for complete search history.

(56) References Cited

U.S. PATENT DOCUMENTS 4,093,116 A * 6/1978 Watkins et al. ..... 229/198.2
4,498,618 A * 2/1985 Sutherland ..... 229/198.2
4,600,140 A * 7/1986 Milliens ..... 229/198.2
4,708,284 A 11/1987 Sutherland et al.
4,723,699 A * 2/1988 Brown et al. ..... 229/198.2
5,002,225 A * 3/1991 Bienaime ..... 229/198.2
5,094,347 A 3/1992 Schuster
5,107,986 A 4/1992 Cooper
5,163,607 A * 11/1992 Kuhn et al. ..... 206/427
5,390,848 A 2/1995 Gungner et al.
5,398,870 A * 3/1995 Bienaime ..... 229/198.2
5,437,363 A 8/1995 Gungner
6,315,123 B1 * 11/2001 Ikeda ..... 229/103.2
6,814,228 B1 * 11/2004 Sutherland ..... 206/427

* cited by examiner

*Primary Examiner*—Gary E. Elkins
(74) *Attorney, Agent, or Firm*—Arnold B. Silverman; Eckert Seamans Cherin & Mellott, LLC

(57) ABSTRACT

There is disclosed a blank for forming a wrap-around carrier sleeve comprising a plurality of panels connected end to end, including first and second end panels at opposite ends of the blank configured to overlap and cooperate to form a bottom of the sleeve. The first end panel includes at least one retainer flap struck from the panel. The second end panel includes at least one male supporting tab connected to the second panel. Each male supporting tab has a notch formed along one side, the notch being sufficiently offset from the fold line in the neck so that, when the second panel overlaps the first panel and the male supporting tab extends through an opening formed by the retainer flap in the first panel, the notch in the male supporting tab lockingly engages a raised edge of the retainer flap.

28 Claims, 6 Drawing Sheets

WRAP-AROUND CARRIER SLEEVE WITH IMPROVED ARTICLE RETAINING FEATURE

BACKGROUND OF THE INVENTION

This invention relates to wrap-around article carriers, sleeves and sleeve blanks.

Wrap-around article carriers are used to enclose a plurality of similarly shaped articles, such as beverage containers. Typically, such an article carrier comprises a sleeve with at least partially open ends. The sleeve is formed by folding a blank comprising a plurality of panels which become the top, bottom and sides of the sleeve. Usually, such a blank will have a generally rectangular shape with end portions of the blank interlocking to form a continuous sleeve for enclosing articles. The blank is constructed from a material that is suitable for folding while possessing sufficient rigidity and strength for use in an article carrier. Paperboard is a common material used in manufacture of article carrier sleeves.

Article carrier sleeves of the kind described above may be rapidly assembled to enclose articles by using machinery designed to form a sleeve from a blank. Such machinery folds the blank into a sleeve surrounding the articles and engages cooperating locks of the blank to maintain the sleeve in an erect state around the articles.

Having at least partially open ends of the sleeve reduces the amount of material required in constructing the article carrier and the number of steps required to form the carrier. However, the absence of material at the ends of the sleeve makes it possible for articles retained within the sleeve to move outwards through the end of the sleeve, possibly falling out, unless some feature is provided for limiting such outward movement. Outward movement of articles retained within the sleeve is a particular problem where the configuration of the articles at the top of the sleeve is different from that at the bottom of the sleeve, such as where the articles are bottles having a narrow neck portion, and a broader curved base portion.

Previous approaches to addressing the above problem include U.S. Pat. No. 5,094,347 issued to Schuster ('347 Schuster), U.S. Pat. No. 5,107,986 issued to Cooper ('986 Cooper). and U.S. Pat. No. 5,390,848 issued to Gungner et al. ('848 Gungner et al.). '347 Schuster, '986 Cooper, and '848 Gungner et al. provide integral article retaining features within the sleeve which are essentially three-dimensional protuberances formed in the bottom of the sleeve adjacent open ends of the sleeve. However, in each case, the machinery used for forming the sleeve must include a movable punch or rod element that forces a retainer flap through a corresponding opening in the inner bottom panel.

In other known sleeve designs, it is not necessary to have movable punch or rod elements in order to form a sleeve. Examples of such sleeves are those provided under the trademark JAK-ET-PAK, as described in U.S. Pat. No. 4,708,284 issued to Sutherland et al. ('284 Sutherland et al.). In '284 Sutherland et al., during formation of the sleeve, a male tab is first folded and then is pushed, by a ramp over which a part of the blank travels, through a corresponding opening (such as a slit) in an inner overlapping portion of the bottom panel of the sleeve so that the male tab extends within the sleeve and is engaged therein. The male tab serves as a secondary locking element for the sleeve and the tab may be positioned within the sleeve so as to separate adjacent articles held within the sleeve. While the kind of automated packaging machinery used to form the sleeve in '284 Sutherland et al. does not require a punch or rod element to push the male tab through the corresponding opening, the '284 Sutherland et al. design lacks the three-dimensional nature of the protuberances found in '347 Schuster, '986 Cooper, and '848 Gungner et al.

Another known design in which it is not necessary to have movable punch or rod elements in the machinery forming the sleeve, but which does provide a three-dimensional protuberance, is disclosed in U.S. Pat. No. 5,437,363 issued to Gungner ('363 Gungner). By forming a three-dimensional protuberance from a retainer flap using a male supporting tab, '363 Gungner is intended to provide the article retaining features of '347 Schuster, '986 Cooper, and '848 Gungner et al., while maintaining simplicity in formation associated with the sleeve in '284 Sutherland et al. However, the sleeve in '363 Gungner suffers from the drawback that the structural integrity of the three-dimensional protuberance may be compromised. What is needed is an improved design for an article retaining sleeve that addresses this drawback.

SUMMARY OF THE INVENTION

This invention provides a blank for forming a wrap-around carrier sleeve comprising a plurality of panels connected end to end, including first and second end panels at opposite ends of the blank configured to overlap and cooperate to form a bottom of the sleeve. The first end panel will be the inner bottom panel of the sleeve and includes at least one retainer flap struck from the panel. The retainer flap is joined to the first panel along a fold line. A free end of the retainer flap forms an opening in the first end panel to receive a corresponding male supporting tab. The second end panel will be the outer bottom panel of the sleeve and includes at least one male supporting tab connected to the second panel. The point at which the male supporting tab is connected to the second panel may have a fold line provided thereat facilitating folding of the male supporting tab during sleeve formation. Each male supporting tab has a notch formed along one side, the notch being sufficiently offset from the fold line in the neck so that, when the second panel overlaps the first panel and the male supporting tab extends through the opening in the first panel from which the retainer flap is struck, the notch in the male supporting tab lockingly engages a raised edge of the retainer flap. The retainer flap and the male supporting tab form a locked three-dimensional protuberance within the sleeve that serves to more securely limit movement of an article adjacent the retainer flap in the sleeve towards an open end of the sleeve.

Each male supporting tab may have a basal notch formed on an opposite side of the offset notch, the basal notch being adjacent the base of the neck so that, when the male supporting tab is fully extended through the opening in the first panel, the basal notch engages the inner bottom panel formed by the first panel. Various designs for the basal notch are known in the art and may be employed in this invention.

In an embodiment, each retainer flap may have at least one secondary fold line extending from an edge of the retainer flap not connected to the first panel, such that as the retainer flap is raised by the male supporting tab, the retainer flap is folded and forms an apex at an edge of the retainer flap. In this case, the apex is lockingly engaged in the offset notch in the male supporting tab.

In an embodiment, the retainer flap has at least two secondary fold lines, each having a configuration generally corresponding to the configuration of the outer surface of an adjacent article to be retained, whereby the shape of the facets formed when the retainer flap is folded at the secondary fold lines will complement the outer surfaces of adjacent articles.

In an aspect of the invention, there is provided a blank for forming a wrap-around article carrier sleeve comprising a plurality of panels connected end-to-end including first and second end panels at opposite ends of the blank that cooperate to form a bottom of the carrier sleeve, wherein the first end panel includes at least one retainer flap struck from the panel thereby defining an opening in the panel, the retainer flap being joined to the first end panel at a fold line, and wherein the second end panel is configured to underlie the first end panel outside the bottom of the carrier sleeve and includes at least one male supporting tab joined to the second end panel; and wherein the male supporting tab is configured to extend through the opening in the first panel from which the retainer flap is struck, the male supporting tab having a notch formed on one side, the notch being offset from the point at which the male supporting tab is joined to the second end panel and configured to lockingly engage a raised part of the retainer flap within the carrier sleeve when inserted into the opening during formation of the carrier sleeve.

In an embodiment, a fold line is provided at the point at which the male supporting tab is joined to the second end panel, such that the notch is offset from the fold line.

In another embodiment, the notch is configured to lockingly engage a raised edge of the retainer flap when the male supporting tab is inserted into the opening during formation of the carrier sleeve.

In another embodiment, the retainer flap has at least one secondary fold line extending from an edge of the retainer flap not connected to the first panel for facilitating folding of the retainer flap.

In another embodiment, the retainer flap when raised and folded at the at least one secondary fold line is configured to form an apical edge, and wherein the notch of the male supporting tab is configured to lockingly engage the formed apical edge.

In another embodiment, each secondary fold line is curved.

In another embodiment, the notch of the male supporting tab is a first notch and the male supporting tab has a basal notch configured to lockingly engage the first end panel when the male supporting tab is inserted into the opening during formation of the carrier sleeve.

In another embodiment, the basal notch is formed on a side opposite the side having the first notch.

In another embodiment, the fold line joining the retainer flap to the first panel is positioned more adjacent an outer side edge of the first panel than the raised part of the retainer flap.

In another embodiment, the fold line joining the retainer flap to the first panel is positioned adjacent an outer side edge of the first panel, and the raised edge of the retainer flap is oriented inwardly from the outer side edge.

In another embodiment, two secondary fold lines extend from opposite edges of the retainer flap and generally converge towards the raised edge of the retainer flap such that, when folded at the secondary fold lines, the retainer flap is configured to form an apical edge suitable for locking engagement in the notch.

In another embodiment, the fold line joining the retainer flap to the first end panel is substantially perpendicular to the fold line joining the male supporting tab to the second end panel.

In another embodiment, the blank further comprises male and female primary locking elements for locking engagement of the first and second panels in the carrier sleeve.

In another embodiment, the blank has two male supporting tabs adjacent opposite sides of the second panel and two retainer flaps adjacent opposite sides of the first panel.

In another aspect of the invention, there is provided a wrap-around article carrier sleeve formed from a blank comprising a plurality of panels connected end-to-end including first and second end panels at opposite ends of the blank that cooperate to form a bottom of the carrier sleeve, wherein the first end panel includes at least one retainer flap struck from the panel thereby defining an opening in the panel, the retainer flap being joined to the first end panel at a fold line, and wherein the second end panel is configured to underlie the first end panel outside the bottom of the carrier sleeve and includes at least one male supporting tab joined to the second end panel; and wherein the male supporting tab is configured to extend through the opening in the first panel from which the retainer flap is struck, the male supporting tab having a notch formed on one side, the notch being offset from the point at which the male supporting tab is joined to the second end panel and configured to lockingly engage a raised part of the retainer flap within the carrier sleeve when inserted into the opening during formation of the carrier sleeve.

The foregoing and other aspects of the invention will be apparent from the following more particular descriptions of exemplary embodiments.

BRIEF DESCRIPTION OF DRAWINGS

In the figures which illustrate exemplary embodiments of the invention.

DETAILED DESCRIPTION

Figure 1A:
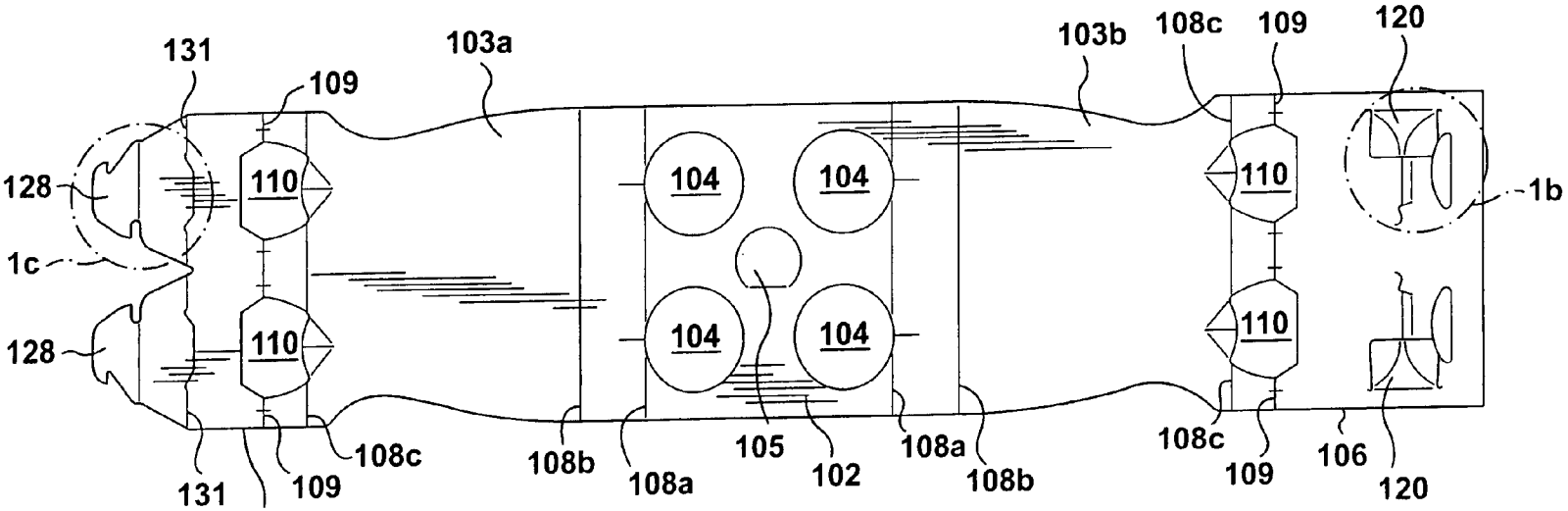
FIG. 1*a* is a plan view of a flat blank for forming a carrier sleeve in accordance with an embodiment of the invention.
Figure 1C:
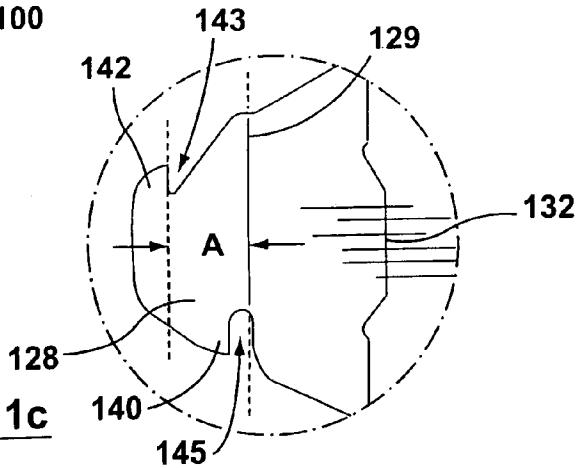
FIG. 1*c* is an enlarged detail of a male supporting tab connected to a second end of the blank shown in FIG. 1*a*.
Figure 1B:
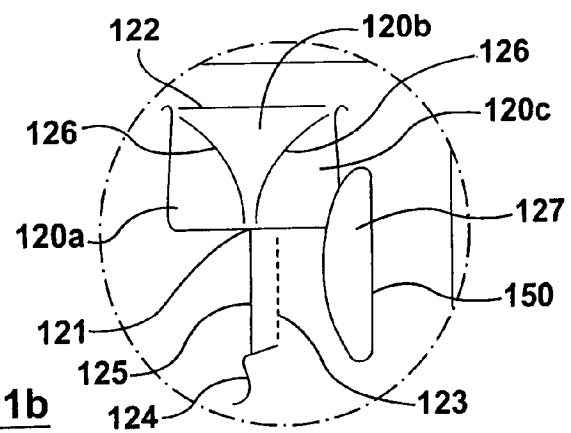
FIG. 1*b* is an enlarged detail of a retainer flap struck into a first end of the blank shown in FIG. 1*a*.
Figure 3C:
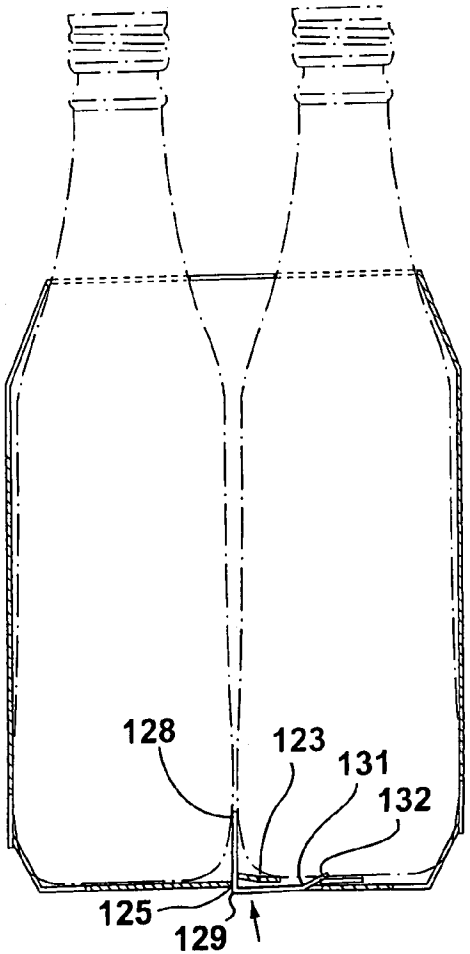
FIGS. 3*a*–3*c* are a sequence of cross-sectional views taken from FIGS. 2*a*–2*c*.

Referring to FIGS. 1*a*–1*c*, a blank 100 of this invention comprises a substantially rectangular sheet of paperboard or other suitable material. The blank 100 comprises a plurality of panels connected end to end, including a middle panel 102 that will form the top of the wrap-around article carrier sleeve and side panels 103*a*, 103*b* that will form sides of the sleeve. Top panel 102 may be provided with through-holes or cut-away portions 104 for receiving the top portion of articles to be enclosed by the sleeve and a handle 105, which in this embodiment is a through-hole. The blank 100 also comprises first end panel 106 and second end panel 107 located at opposite ends of the blank 100. Each end panel 107, 106 is connected to a side panel 103*a*, 103*b*, respectively, at fold lines which in this embodiment are fold lines 109. Likewise, side panels 103*a* and 103*b* are connected to top panel 102 at fold lines 108*a*. Secondary fold lines 108*b* and 108*c*, as shown in this illustrative example, may be suitably positioned to allow a sleeve 100*a* formed from the blank 100 to better fit around the shape of the articles to be held in the sleeve (e.g. as shown in FIG. 3*a*).

Fold lines 109 define the bottom edges of the sides of the sleeve 100*a*. Situated along fold lines 109 are cut-outs 110 that provide clearance for the bottom of articles enclosed within the sleeve 100*a*.

End panel 106 has two retainer flaps 120, each of which is hinged to the bottom panel 106 at fold line 122 and comprises three sections 120*a*, 120*b*, 120*c*, separated by secondary fold lines 126 (as best shown in FIG. 1*b*). These retainer flaps are struck during formation of the blank 100. As will be further detailed below, the sections 120*a*, 120*b*, 120*c* of the retainer flaps 120, once folded at the fold lines 126 and at hinge line 122, form an apex at an edge 121 of the retainer flaps 120. Fold lines 122 are adjacent to and generally parallel with the sides of bottom panel 106. In an embodiment, the entire length of section 120*b* may be attached to the end panel 106 at hinge line 122, so as to provide maximum support for the three-dimensional protuberance formed by the retainer flaps 120 (as will be detailed further below).

As shown in FIG. 1*b*, adjacent each retainer flap 120 is a slit 125. To facilitate entry of a male support tab 128 (of bottom panel 107) through the slit 125 during formation of the sleeve 100*a*, a parallel score line 123 and a curved cut line 124 may be provided in known manner. A cut-out 127 provided adjacent the retainer flap 120 becomes a primary female locking element for the formed sleeve 100*a* (as will be explained further below).

Two male supporting tabs 128 extend from bottom panel 107 and are connected to the bottom panel 107 by necks having fold lines 129. Formed into one side of each male supporting tab 128 is a notch 143 (as best shown in FIG. 1*c*) offset from the fold line 129 in the neck by an offset distance "A". The offset distance "A" is suitably selected so as to allow notch 143 to receive and lockingly engage apical edge 121 of retainer flap 120 when the retainer flap 120 is raised by the male supporting tab 128. In this illustrative example, the notch 143 is formed below a nose 142 protruding from one side of the male supporting tab 128. However, it will be appreciated that any notch capable of receiving and lockingly engaging a raised portion of the retainer flap 120 may be provided on the male supporting tab 128.

In an embodiment, formed into each male supporting tab 128 on a side opposite the side of the notch 143 is a basal notch 145. As shown, in known manner, the basal notch 145 is formed below a nose 140 with virtually no offset from the fold line 129. As will be explained further below, the basal notch 145 of a male supporting tab 128 may further secure the tab when forming a three-dimensional protuberance with a corresponding retainer flap 120.

As will be appreciated by those skilled in the art, the male supporting tabs 128 and corresponding retainer flaps 120 are designed to form a secondary lock for the sleeve 100*a* and to better support articles within the sleeve. In order to provide additional support for the articles contained in the formed sleeve 100*a*, primary male locking elements 132 (formed by slits that interrupt fold line 131), engage the primary female locking elements 127 of bottom panel 106. The formation of the sleeve 100*a* from blank 100, including engagement of the primary male locking elements 132 and primary female locking elements 127, will now be explained.

In the present illustrative embodiment, as a first step, the neck of articles (e.g. bottles) 200 are inserted through cut-out 104 in middle panel 102 of the blank 100.

Figure 2:
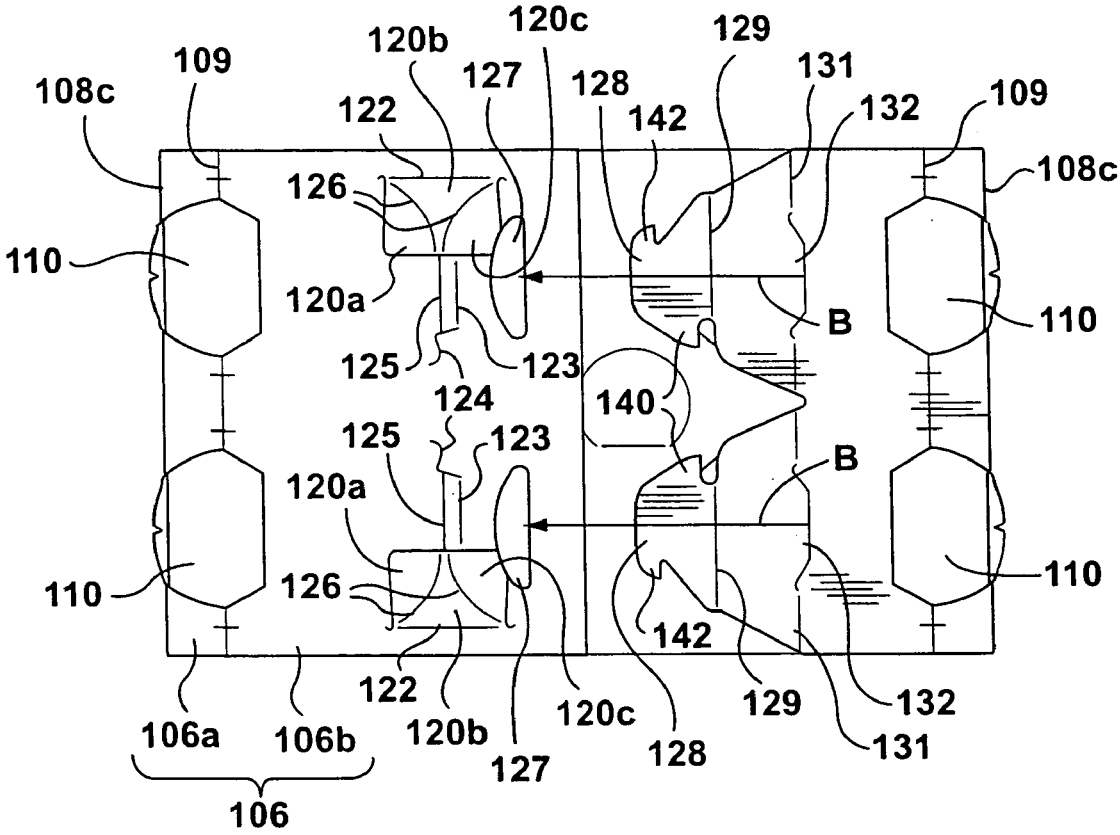
FIG. 2 is an enlarged plan view of the first and second ends of the blank shown in FIG. 1*a*, which form the inner and outer bottom panels of the sleeve respectively, just prior to being positioned in an overlapped condition.

Referring now to FIG. 2, bottom panel 106 and outer bottom panel 107 are shown at a stage in forming the sleeve 100*a*, wherein the panels 106, 107 are about to be overlapped so that panel 107 will underlie panel 106 at the bottom of the sleeve. Panel 107 is brought to underlie panel 106, so that male supporting tabs 128 align with retainer flaps 120, and primary male locking elements 132 align with primary female locking elements 127.

Figure 2A:
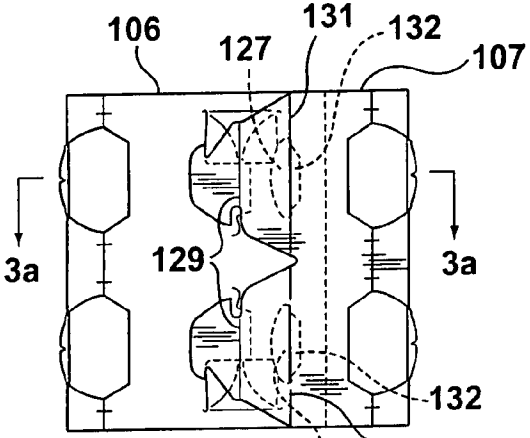
FIGS. 2*a*–2*c* are a sequence of plan views showing how the male supporting tab of FIG. 1*c* engages the retainer flap of FIG. 1*b* to form a wrap-around sleeve.

As show in FIG. 2*a*, and in the corresponding cross-section in FIG. 3*a*, the primary male locking elements 132 are inserted into the primary female locking elements 127 and engage an edge 150 of the female locking elements 127 so that the bottom panels 106, 107 are prevented from separating from each other (at least to the extent of the designed rip strength of the material used for blank 100). FIG. 3*a* shows illustrative bottles 200 in dashed outline to indicate how the sleeve 100*a* is formed in place around such bottles 200, with the top portion of the bottles being received in the cut-outs 104 of the sleeve 100*a*. As shown, the bottom panel 107 may be folded at fold line 131 in order to properly angle the primary locking elements 132 for insertion into the primary female locking elements 127.

Figure 2C:
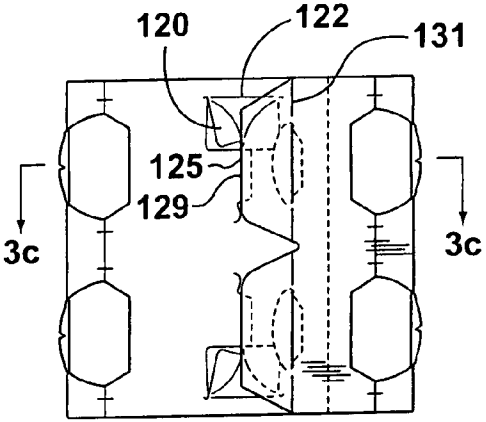
Figure 2B:
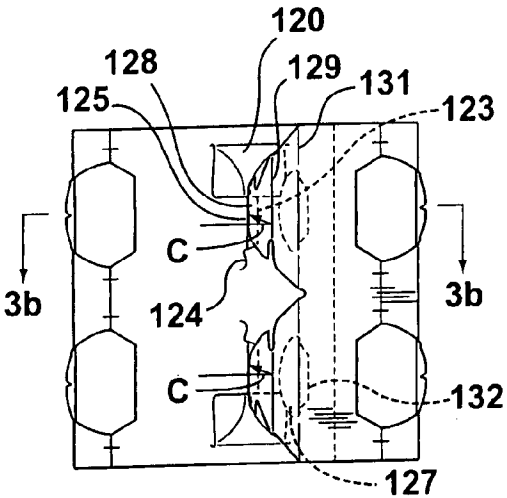
Figure 3B:
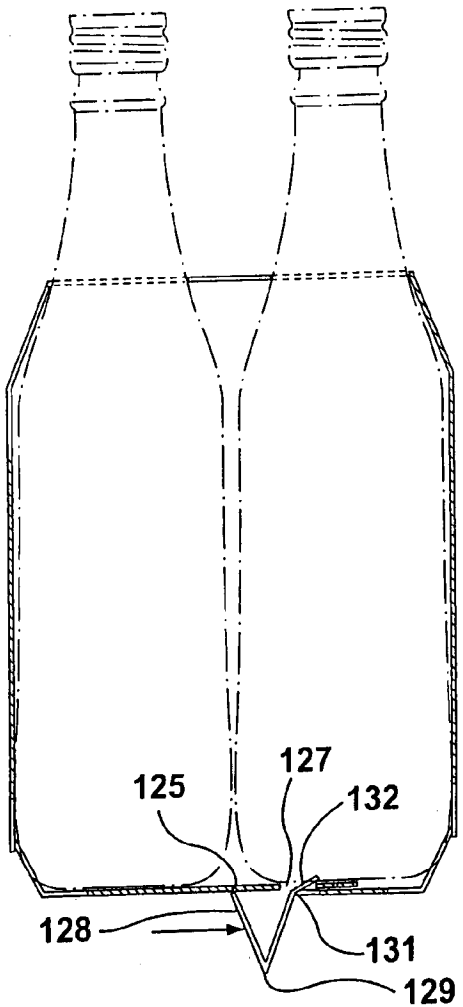
Figure 3A:
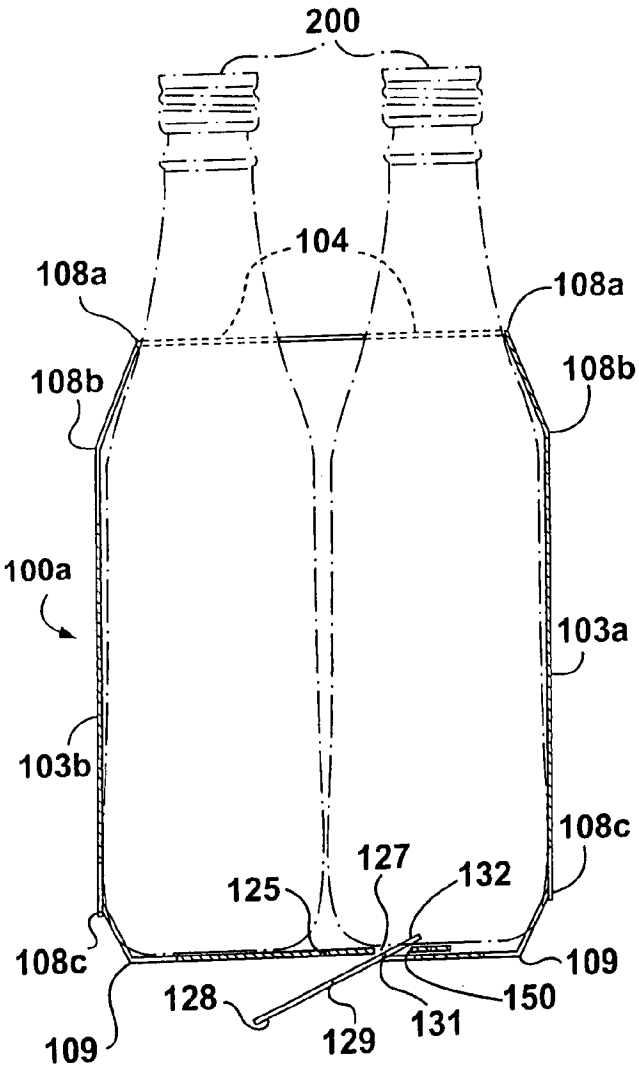

Now referring to FIG. 2*b*, and the corresponding cross-section in FIG. 3*b*, each male supporting tab 128 is shown folded at the neck at fold line 129, and the leading edge of each male supporting tab 128 is positioned next to a corresponding slit 125 in preparation for insertion into the slit 125. As explained above with respect to FIG. 1*b*, score lines 123 and secondary curved cut lines 124 may be provided to make insertion of the male supporting tabs 128 into the slits 125 easier. Also, as shown, the primary female and male locking elements 127, 132 will maintain the panels 106, 107 in position relative to each other during this insertion procedure.

Referring to FIG. 2*c*, and the corresponding cross-section in FIG. 3*c*, the male supporting tabs 128 are shown inserted into the corresponding slits 125. As the male supporting tabs 128 are inserted, each retainer flap 120 connected to bottom flap 106 at fold line 122 is raised at its free end by a leading edge of a respective male supporting tab 128. In the illustrative example, each fold line 122 is substantially perpendicular to fold line 129 of the corresponding male supporting tab 128.

Figure 4:
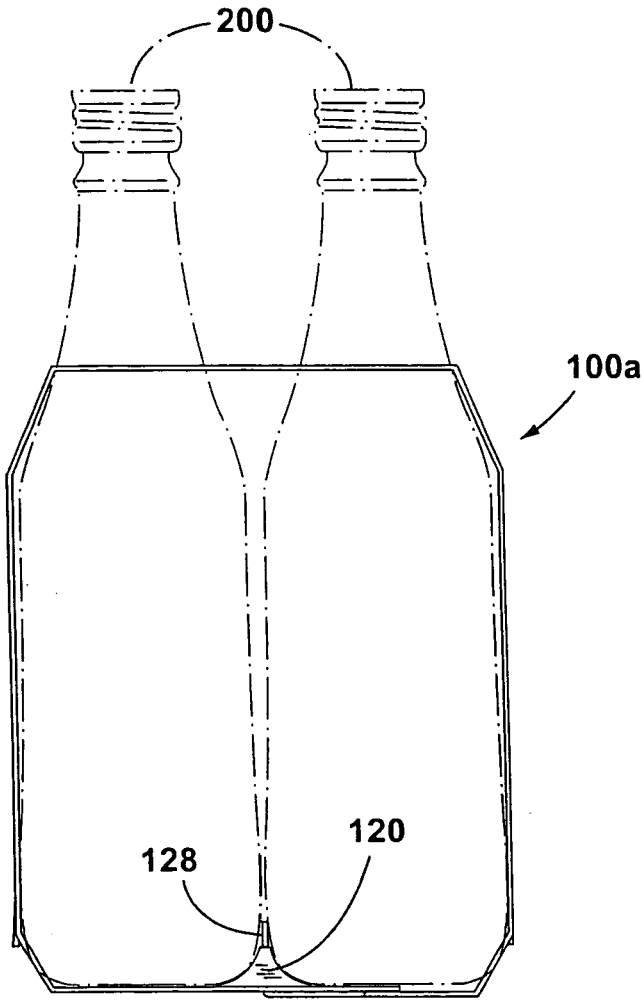
FIG. 4 is an end view of a formed sleeve, with the retainer flap of FIG. 1*b* raised into a locked three-dimensional protuberance to retain articles in the sleeve.
Figure 5A:
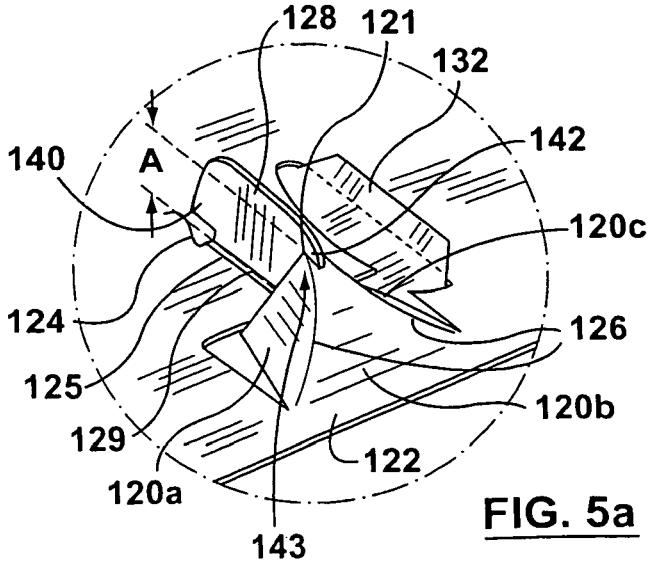
FIG. 5*a* is a partial perspective view detailing the locked three-dimensional protuberance formed by the retainer flap of FIG. 1*b* and male supporting tab of FIG. 1*c*.
Figure 6:
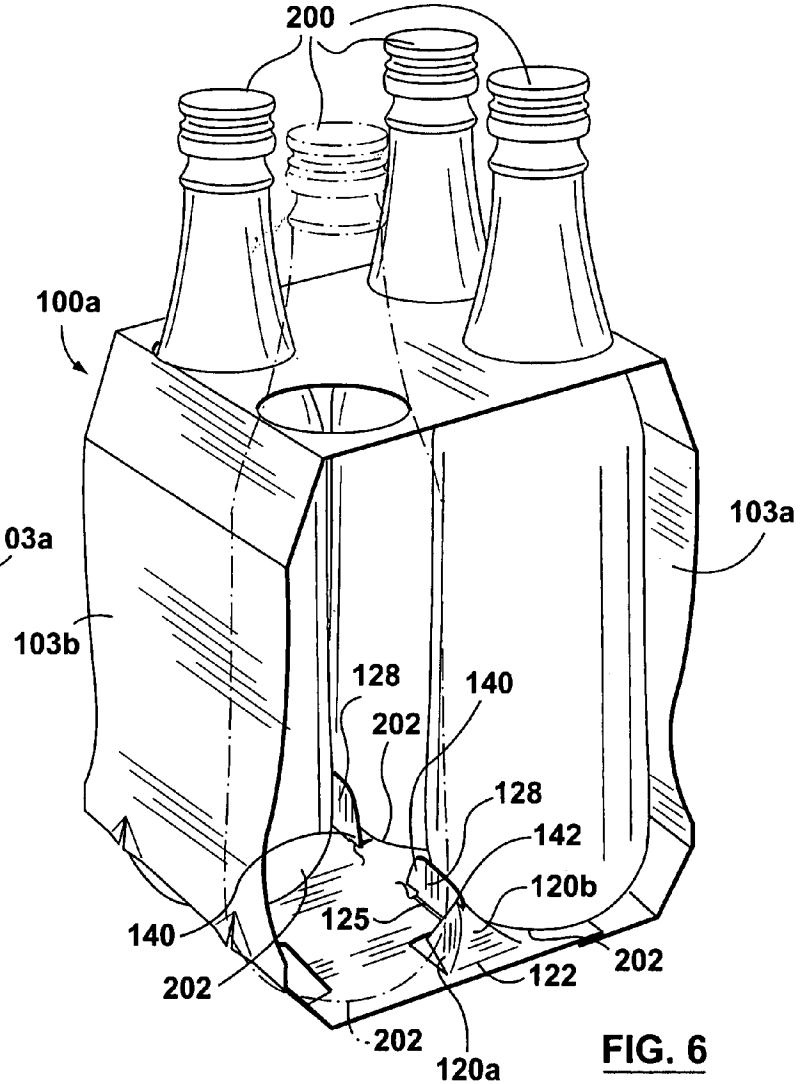
FIG. 6 is another perspective view of the formed sleeve as shown in FIG. 5 but with some of the articles replaced.
Figure 5:
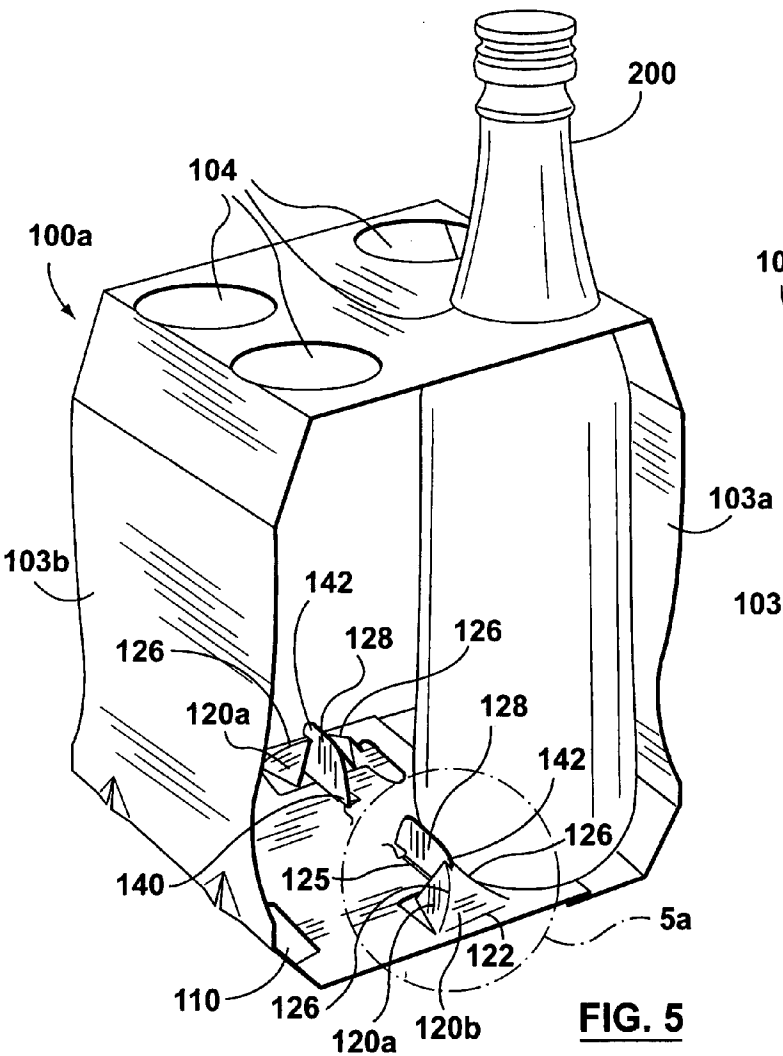
FIG. 5 is a perspective view of the formed sleeve of FIG. 4 with some of the articles removed to show the locked three-dimensional protuberances formed by the retainer flaps.

In this illustrative example, the raised edge of the retainer flap is oriented inwardly from an outer edge of the panel 106. As the male supporting tabs 128 are further extended into the slits 125, apical edge 121 of the raised retainer flap 120 snaps into a notch (offset notch 143 in FIG. 1*c*) formed into the side of the each male supporting tab 128. The notch 143 lockingly engages a raised part of the retainer flap 120 and a locked three-dimensional protuberance is formed inside sleeve 100*a* (as best shown in FIGS. 5 and 5*a*). Such a fully formed three-dimensional protuberance is shown in an end plan view of the sleeve 100*a* in FIG. 4.

In the present illustrative example, as shown in FIG. 5 and 5*a*, the three-dimensional protuberance is formed by folding the retainer flap 120 along suitably shaped secondary fold lines 126. In this regard, it will be appreciated that placement of the bottles 200 will assist in causing the retainer flaps 120 to fold along the fold lines 126. The three sections 120*a*, 120*b*, 120*c* of the retainer flaps 120 folded along fold lines 126 form a pyramid-like structure with an apical edge 121 (FIG. 1*b*) at the top of the sections 120*a*, 120*b*, 120*c*. The apical edge 121 is received by the notch 143 formed on one side of the male supporting tab 128 to securely lock the pyramid-like structure in position.

Still referring to FIGS. 5 and 5*a*, as shown, the secondary fold lines 126 may be suitably shaped to conform to the shape of the bottles 200 to be retained. In this example, the curve of the fold lines 126 allow the base portions of the bottles 200 to be seated more securely against the three-dimensional protuberance formed by the retainer flaps 120 and male supporting tabs 128.

As shown in FIG. 5*a*, in the present illustrative embodiment, basal notches 145, as known in the art, may also be provided opposite the side of the offset notch 143. The basal notches 145 may provide a more secure lock for the three-dimensional protuberance by preventing the male supporting tabs 128 from being readily withdrawn from the slots 125.

Formation of the carrier sleeve as illustrated in the preceding figures may be carried out on machinery for forming folding carton wraps with a "lock-bottom" such as are provided under the trademark JAK-ET-PAK and the carrier sleeve described in U.S. Pat. No. 4,708,284, the contents of which are incorporated by reference herein. Such machinery is designed to fold a male supporting tab similar to that shown in the figures as male supporting tab 128 and direct such a tab through corresponding openings or slits in a sleeve panel without the need for separate movable punches or rod elements in the machinery.

Advantageously, a three-dimensional protuberance that is securely locked in position may allow articles (e.g. bottles) 200 to be better retained within the formed sleeve 100*a*. At the same time, the simplicity in forming the sleeve 100*a* with less complex sleeve forming machinery has been retained.

While exemplary embodiments of the invention have been shown and described, it will be appreciated by those skilled in the art that variations and modifications may be made without departing from the scope of the invention.

Thus, the scope of the invention is limited only by the following claims.

What is claimed is:

1. A blank for forming a wrap-around article carrier sleeve comprising a plurality of panels connected end-to-end including first and second end panels at opposite ends of the blank that cooperate to form a bottom of the carrier sleeve, wherein the first end panel includes at least one retainer flap struck from the panel thereby defining an opening in the panel, the retainer flap being joined to the first end panel at a fold line, and wherein the second end panel is configured to underlie the first end panel outside the bottom of the carrier sleeve and includes at least one male supporting tab joined to the second end panel; and wherein the male supporting tab is configured to extend through the opening in the first panel from which the retainer flap is struck, the male supporting tab having a notch formed on one side, the notch being offset from the point at which the male supporting tab is joined to the second end panel and configured to lockingly engage a raised part of the retainer flap within the carrier sleeve when inserted into the opening during formation of the carrier sleeve.

2. The blank of claim 1, wherein a fold line is provided at the point at which the male supporting tab is joined to the second end panel, such that the notch is offset from the fold line.

3. The blank of claim 1, wherein the notch is configured to lockingly engage a raised edge of the retainer flap when the male supporting tab is inserted into the opening during formation of the carrier sleeve.

4. The blank of claim 3, wherein the retainer flap has at least one secondary fold line extending from an edge of the retainer flap not connected to the first panel for facilitating folding of the retainer flap.

5. The blank of claim 4, wherein the retainer flap when raised and folded at the at least one secondary fold line is configured to form an apical edge, and wherein the notch of the male supporting tab is configured to lockingly engage the formed apical edge.

6. The blank of claim 4, wherein each secondary fold line is curved.

7. The blank of claim 1, wherein the notch of the male supporting tab is a first notch and wherein the male supporting tab has a basal notch configured to lockingly engage the first end panel when the male supporting tab is inserted into the opening during formation of the carrier sleeve.

8. The blank of claim 7, wherein the basal notch is formed on a side opposite the side having the first notch.

9. The blank of claim 2, wherein the fold line joining the retainer flap to the first panel is positioned more adjacent an outer side edge of the first panel than the raised part of the retainer flap.

10. The blank of claim 9, wherein the fold line joining the retainer flap to the first panel is positioned adjacent an outer side edge of the first panel, and the raised edge of the retainer flap is oriented inwardly from the outer side edge.

11. The blank of claim 10, wherein two secondary fold lines extend from opposite edges of the retainer flap and generally converge towards the raised edge of the retainer flap such that, when folded at the secondary fold lines, the retainer flap is configured to form an apical edge suitable for locking engagement in the notch.

12. The blank of claim 2, wherein the fold line joining the retainer flap to the first end panel is substantially perpendicular to the fold line joining the male supporting tab to the second end panel.

13. The blank of claim 1, further comprising male and female primary locking elements for locking engagement of the first and second panels in the carrier sleeve.

14. The blank of claim 1, having two male supporting tabs adjacent opposite sides of the second panel and two retainer flaps adjacent opposite sides of the first panel.

15. A wrap-around article carrier sleeve formed from a blank comprising a plurality of panels connected end-to-end including first and second end panels at opposite ends of the blank that cooperate to form a bottom of the carrier sleeve, wherein the first end panel includes at least one retainer flap struck from the panel thereby defining an opening in the panel, the retainer flap being joined to the first end panel at a fold line, and wherein the second end panel is configured to underlie the first end panel outside the bottom of the carrier sleeve and includes at least one male supporting tab joined to the second end panel; and wherein the male supporting tab is configured to extend through the opening in the first panel from which the retainer flap is struck, the male supporting tab having a notch formed on one side, the notch being offset from the point at which the male supporting tab is joined to the second end panel and configured to lockingly engage a raised part of the retainer flap within the carrier sleeve when inserted into the opening during formation of the carrier sleeve.

16. The carrier sleeve of claim 15, wherein a fold line is provided at the point at which the male supporting tab is joined to the second end panel, such that the notch is offset from the fold line.

17. The carrier sleeve of claim 15, wherein the notch is configured to lockingly engage a raised edge of the retainer flap when the male supporting tab is inserted into the opening during formation of the carrier sleeve.

18. The carrier sleeve of claim 17, wherein the retainer flap has at least one secondary fold line extending from an edge of the retainer flap not connected to the first panel for facilitating folding of the retainer flap.

19. The carrier sleeve of claim 18, wherein the retainer flap when raised and folded at the at least one secondary fold line is configured to form an apical edge, and wherein the notch of the male supporting tab is configured to lockingly engage the formed apical edge.

20. The carrier sleeve of claim 18, wherein each secondary fold line is curved.

21. The carrier sleeve of claim 15, wherein the notch of the male supporting tab is a first notch and wherein the male supporting tab has a basal notch configured to lockingly engage the first end panel when the male supporting tab is inserted into the opening during formation of the carrier sleeve.

22. The carrier sleeve of claim 21, wherein the basal notch is formed on a side opposite the side having the first notch.

23. The carrier sleeve of claim 16, wherein the fold line joining the retainer flap to the first panel is positioned more adjacent an outer side edge of the first panel than the raised part of the retainer flap.

24. The carrier sleeve of claim 23, wherein the fold line joining the retainer flap to the first panel is positioned adjacent an outer side edge of the first panel, and the raised edge of the retainer flap is oriented inwardly from the outer side edge.

25. The carrier sleeve of claim 24, wherein two secondary fold lines extend from opposite edges of the retainer flap and generally converge towards the raised edge of the retainer flap such that, when folded at the secondary fold lines, the retainer flap is configured to form an apical edge suitable for locking engagement in the notch.

26. The carrier sleeve of claim 16, wherein the fold line joining the retainer flap to the first end panel is substantially perpendicular to the fold line joining the male supporting tab to the second end panel.

27. The carrier sleeve of claim 15, further comprising male and female primary locking elements for locking engagement of the first and second panels in the carrier sleeve.

28. The carrier sleeve of claim 15, having two male supporting tabs adjacent opposite sides of the second panel and two retainer flaps adjacent opposite sides of the first panel.

* * * * *